US008588334B2

(12) United States Patent
McGowan et al.

(10) Patent No.: US 8,588,334 B2
(45) Date of Patent: Nov. 19, 2013

(54) ROBUST ANTENNA ARRAY

(75) Inventors: Neil McGowan, Stittsville (CA); Marthuinus Willem Da Silveira, Ottawa (CA)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 178 days.

(21) Appl. No.: 13/188,904

(22) Filed: Jul. 22, 2011

(65) Prior Publication Data

US 2013/0022152 A1 Jan. 24, 2013

(51) Int. Cl.
*H04L 27/00* (2006.01)

(52) U.S. Cl.
USPC ..... 375/299; 455/25; 455/63.4; 455/69; 455/101; 330/84

(58) Field of Classification Search
USPC ..... 375/299; 455/25, 63.4, 69, 101; 330/84
See application file for complete search history.

(56) References Cited

U.S. PATENT DOCUMENTS

| | | | | |
|---|---|---|---|---|
| 3,174,150 | A * | 3/1965 | Sferrazza et al. | 342/423 |
| 5,805,575 | A * | 9/1998 | Kamin, Jr. | 370/335 |
| 5,834,972 | A | 11/1998 | Schiemenz et al. | |
| 7,139,539 | B2 | 11/2006 | Chun | |
| 7,206,355 | B2 | 4/2007 | McGowan et al. | |
| 7,248,656 | B2 | 7/2007 | Da Silveira et al. | |
| 7,508,885 | B2 | 3/2009 | McGowan et al. | |
| 7,720,449 | B2 | 5/2010 | Porco et al. | |
| 2003/0036361 | A1 * | 2/2003 | Kawai et al. | 455/69 |
| 2004/0105509 | A1 | 6/2004 | McGowan et al. | |
| 2004/0228422 | A1 * | 11/2004 | Silveira et al. | 375/299 |
| 2007/0026899 | A1 | 2/2007 | Porco et al. | |
| 2007/0099578 | A1 * | 5/2007 | Adeney et al. | 455/69 |
| 2010/0090762 | A1 * | 4/2010 | van Zelm et al. | 330/84 |

FOREIGN PATENT DOCUMENTS

WO WO98/08321 A1 2/1998

OTHER PUBLICATIONS

Search Report PCT/IB2012/053639.

* cited by examiner

*Primary Examiner* — Sam K Ahn
*Assistant Examiner* — Fabricio R Murillo Garcia
(74) *Attorney, Agent, or Firm* — David J. Rahmer; Ericsson Canada Inc.

(57) ABSTRACT

A wireless communication system that includes a robust transmitter array. The robust transmitter array includes an antenna array system with at least one column, at least one antenna element, and at least one polarization, a plurality of transmitter devices to transmit analog voice/data signals through the antenna array system, and a signal processor. The signal processor modifies two or more input signals in the event of a transmitter device failure such that substantially similar amounts of each of the two or more input signals are output from the transmitter system to the antenna array system, and wherein substantially less transmitted signal power is lost than in the case wherein the signal processor does not modify the two or more input signals in the event of a transmitter failure.

18 Claims, 10 Drawing Sheets

| Configuration | Power boosting | Azimuth Pattern Integrated Impairment Ratio [dB] | Elevation Pattern Integrated Impairment Ratio [dB] |
|---|---|---|---|
| Baseline | none | -9 dB | -17 dB |
| Robust | none | -13 dB | -25 dB |
| Baseline | 6 dB | <-100 dB | -12 dB |
| Baseline | 4.8 dB | <-100 dB | <-100 dB |

FIG. 9

ROBUST ANTENNA ARRAY

TECHNICAL FIELD

The present invention generally relates to radio communication systems, devices and methods and, more particularly, to antenna array devices, systems and methods.

BACKGROUND

At its inception radio telephony was designed, and used for, voice communications. As the consumer electronics industry continued to mature, and the capabilities of processors increased, more devices became available use that allowed the wireless transfer of data between devices and more applications became available that operated based on such transferred data. Of particular note are the Internet and local area networks (LANs). These two innovations allowed multiple users and multiple devices to communicate and exchange data between different devices and device types. With the advent of these devices and capabilities, users (both business and residential) found the need to transmit data, as well as voice, from mobile locations.

The infrastructure and networks which support this voice and data transfer have likewise evolved. Limited data applications, such as text messaging, were introduced into the so-called "2G" systems, such as the Global System for Mobile (GSM) communications. Packet data over radio communication systems became more usable in GSM with the addition of the General Packet Radio Services (GPRS). 3G systems and, then, even higher bandwidth radio communications introduced by Universal Terrestrial Radio Access (UTRA) standards made applications like surfing the web more easily accessible to millions of users (and with more tolerable delay).

As air interface technologies become more complex to meet the ever increasing demand for wireless voice and data services, the number of antennas being deployed at cell-tower sites, and other places, increases, and thus the number of radios required also increases. As a result, the number of coaxial cables between radios and antennas at each of these cites increase as well. As the number of radios and coaxial cables increases, the associated weight, cost and maintenance issues also increase. In some sites it is prohibitively expensive to deploy more coaxial cables to meet the new air interface needs.

Furthermore, radios in enclosures and remotely located radios are being deployed in ever increasing numbers for communication systems that provide the wireless voice and data systems. These radios can have a mean-time-between-failure (MTBF) on the order of 10 to 20 years, and therefore should be deployed in locations where they can be replaced when a failure occurs.

Some solutions have been proposed to address these issues. In order to provide a high level of quality of service, redundant systems can be put in place, and this means additional radios (transmitters, receivers, or transceivers) and even more coaxial cables. Thus, the number of radios in an enclosure can increase even further, and this also increases the number of coaxial cables, which can lead to cost, weight, and in some cases tower loading issues.

Another solution is to move the radios closer to, or combine them with, the antennas, thereby reducing or eliminating the length of the coaxial cables. That is, the radios and antennas can be enclosed or configured as much as practically possible into one integrated unit. While this solution may lead to less coaxial cable weight, it can lead to other problems, such as loading on towers (because in addition to the antenna weight, there is the added weight of the radio itself) and maintenance/repair of the components. Maintaining or replacing radios located on a tower can become prohibitively expensive as these are locations that are difficult to access. Active antennas, i.e., antennas with collocated radios, include digital devices, transceivers, power amplifiers (PA), low noise amplifiers (LNA) and other elements that can fail and/or experience performance degradation over time. If the antennas or antennas with collocated radios experience such performance issues, then failure of the radio can be very costly to replace as noted above.

As discussed above, to compensate for the possibility of failure of antenna/radio devices, it has been suggested that redundant devices be employed. While the digital components, receivers and other elements of the radio can be designed in a redundant configuration to significantly improve MTBF if needed, it is difficult to do this efficiently with the transmitter. Transmitters typically include analog, high power components (especially compared to digital components), and are fairly complex and expensive devices. Switches could be used to select standby transmitters should a transmitter fail, however, the switches themselves can fail and the standby transmitters provide no benefit under normal operation. Furthermore, in most systems, a certain number of standby transmitters would be needed to ensure adequate reliability. Standby transmitters should be kept "on" at a certain operational level, i.e., "warmed up," to nearly instantaneously meet a shutdown condition of one or more of the "regular" transmitters, and thus would consumer additional power. Thus, the net result is an increase in weight and cost.

Accordingly, it would be desirable to provide a wireless voice/data communication system with reliable, substantially fail-safe redundant transmission capabilities that is low cost, and minimizes additional loading as much as is practically possible.

SUMMARY

According to one embodiment, a wireless communication system includes an antenna array system including at least one column with at least one antenna element, and at least one polarization and a transmitter system, including at least three transmitter devices, configured to receive respective input signals, process the respective input signals to generate processed signals and transmit the processed signals through the antenna array system, wherein at least one output port of the transmitter system is connected to a non-antenna load, the transmitter system including a signal processor configured to modify the respective input signals in the event of a failure of one of the at least three transmitter devices, wherein substantially similar amounts of each of the two or more input signals are output from the transmitter system to the antenna array system after the failure.

According to another embodiment, a method of compensating for a failure in at least one of a plurality of transmitter devices in a wireless communication system, includes the steps of receiving at least two input signals to be transmitted, determining that at least one of the plurality of transmitter devices has failed, modifying each of the at least two or more input signals such that substantially similar amounts of signal energy associated with each of the at least two input signals are output from at least two output ports of a transmitting system which are connected to an array antenna, and such that a lower amount of signal energy associated with each of the at least two input signals are output from an additional output port of the transmitting system, the additional output port being connected to a non-antenna load, and transmitting each of the modified at least two input signals via the antenna array.

According to another embodiment, a robust transmitter array includes an antenna array, an analog hybrid matrix connected to the antenna array, a plurality of transmitters connected to the analog hybrid matrix, and a digital hybrid matrix connected to the plurality of transmitters and configured to modify received input signals with weight adjustments, wherein the analog hybrid matrix is connected to the antenna array via at least two ports and is connected to a non-antenna load via at least one port.

BRIEF DESCRIPTION OF THE DRAWINGS

The accompanying drawings, which are incorporated in and constitute a part of the specification, illustrate one or more embodiments and, together with the description, explain these embodiments. In the drawings:

FIG. 9 is a table that summarizes the azimuth and elevation integrated impairment ratios for the baseline and robust transmitter array configurations with and without power boosting according to an embodiment.

DETAILED DESCRIPTION

The following description of the exemplary embodiments of the present invention refers to the accompanying drawings. The same reference numbers in different drawings identify the same or similar elements. The following detailed description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the present invention. Thus, the appearance of the phrases "in one embodiment" or "in an embodiment" in various places throughout the specification are not necessarily all referring to the same embodiment. Further, the particular features, structures or characteristics may be combined in any suitable manner in one or more embodiments.

As discussed above, providing additional coaxial cables, and/or radios to a wireless voice/data communication system creates difficulties, not the least of which are additional costs and loading issues, especially if the antennas are located on a tower. To overcome such difficulties, some redundancy in components can be provided, but such redundant devices also have problems, namely in that the transmitter is the most difficult to maintain and to make redundant. Robust transmitter array (RTA) configurations according to embodiments described below address these and other problems.

According to a first exemplary embodiment, a generalized robust transmitter array is composed of N transceivers with an N×N digital/analog hybrid matrix transform pair. The number of outputs used, M, is less than N to provide some redundancy and N-M unused ports are terminated. With the robust transmitter array, it is possible to compensate completely for a failed transmitter by adjusting the gain of the remaining transmitters in the array appropriately and by modifying the adaptive optimization goals upon detection of the failure. According to a further exemplary embodiment, a soft fail option exists with the robust transmitter array wherein no gain compensation is performed but the impact of a transmitter failure on performance is still much lower than in the baseline case where a transmitter feeds an antenna sub-array directly without the modifications discussed herein. Prior to discussing these embodiments in more detail, a generalized view of a wireless voice/data communication system in which robust transmitter arrays according to embodiments can be used is described in order to provide some context.

Figure 1:
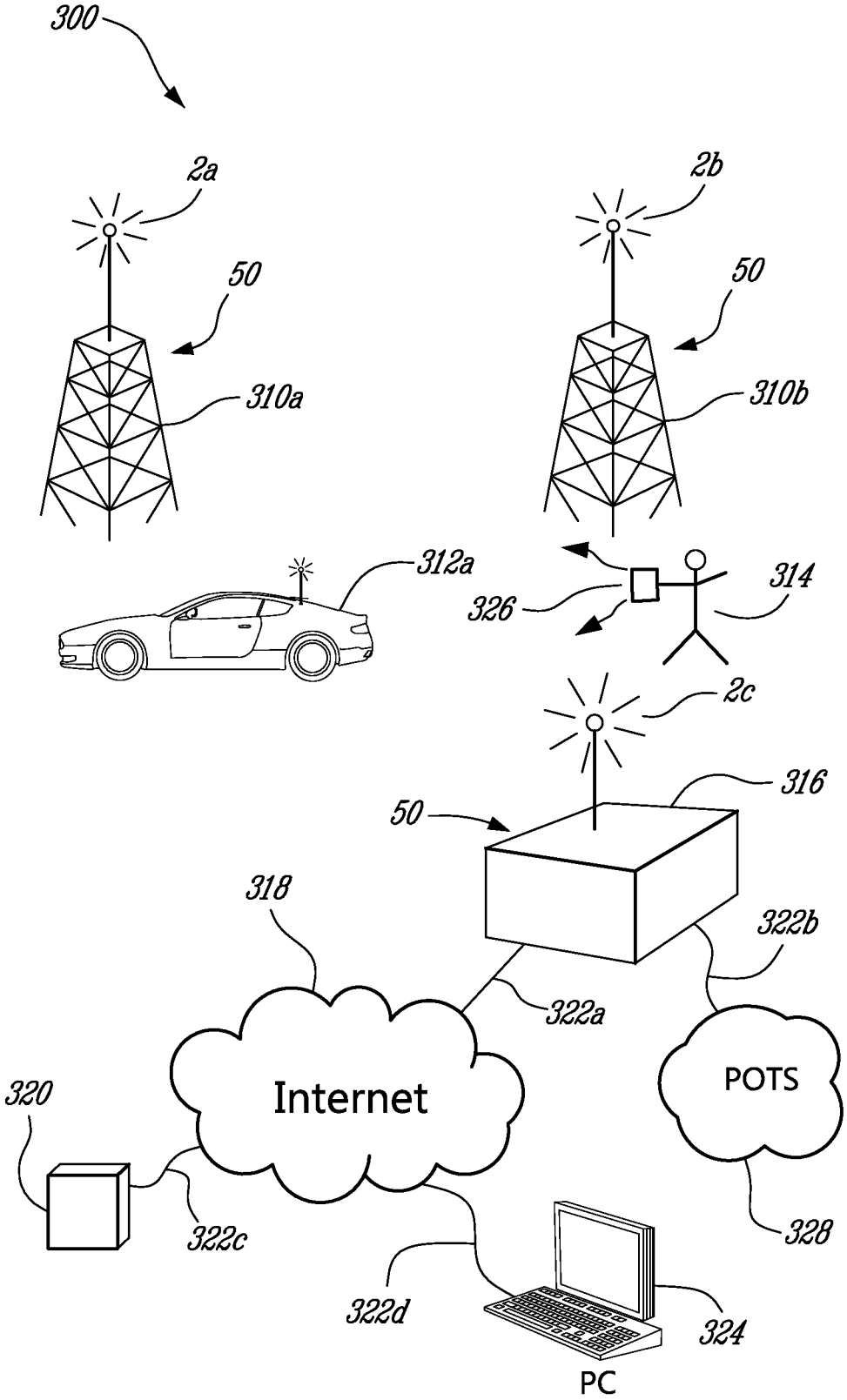
FIG. 1 depicts a generalized view of a wireless voice/data communication system utilizing a robust transmitter array according to an embodiment.

FIG. 1 illustrates a generalized view of a wireless voice/data communication system (cell system) 300 utilizing robust transmitter arrays 50 according to an embodiment. Cell system 300 includes a plurality of base transceiver stations 310*a,b* each of which can include robust transmitter array 50 according to an embodiment. A base station 316 provides an access point for the transmission and receipt of radio signals using, for example, well known communication standards (e.g., GSM, WCDMA, LTE, etc.) to users 314 of cell system 300. Users 314 of cell system 300 can use their cellular or wireless devices 326 either in cars 312*a*, trains, or just about anywhere. Wireless devices 326 can include, but are not limited to, phones, computers, PDAs, digital tablets, headsets, appliances, etc. Omitted from FIG. 1 are elements of the radio access network (RAN) which interconnect the base stations 316 to other networks, e.g., the internet 318 and legacy phone systems (POTS) 328.

Recently, improved cell systems 300 have been implemented that provide for not only texting and voice services, but also for data services, such as for accessing the internet 318 and/or sending and receiving emails, often with photographs and even videos. In this case, user 314 establishes service from wireless device 326 to one or more of base transceiver stations 310*a,b* to base station 316, and then to internet 318 through link 322. In most cases, but not always, link 322 is a high speed fiber optic type cable, so that many users 314 of cell system 300 can access internet 318. Further, once service has been established to internet 318, user 314 can access one or more websites hosted at one or more of a plurality of servers 320, or send and receive emails to personal computing devices 324, which can include home computers (both desktop and laptop), tablets, pads, and a plurality of other types of personal or business computing devices. Of course, some users 314 primarily use their cellular devices to call other users 314, of the same or different cellular network, or people that can be accessed via POTS 328 (plain old telephone service). A more complete and thorough description of cellular networks is both beyond the scope of this disclosure and unnecessary for an understanding of the exemplary embodiments of the present invention and therefore has been omitted for the dual purposes of clarity and brevity.

Figure 2:
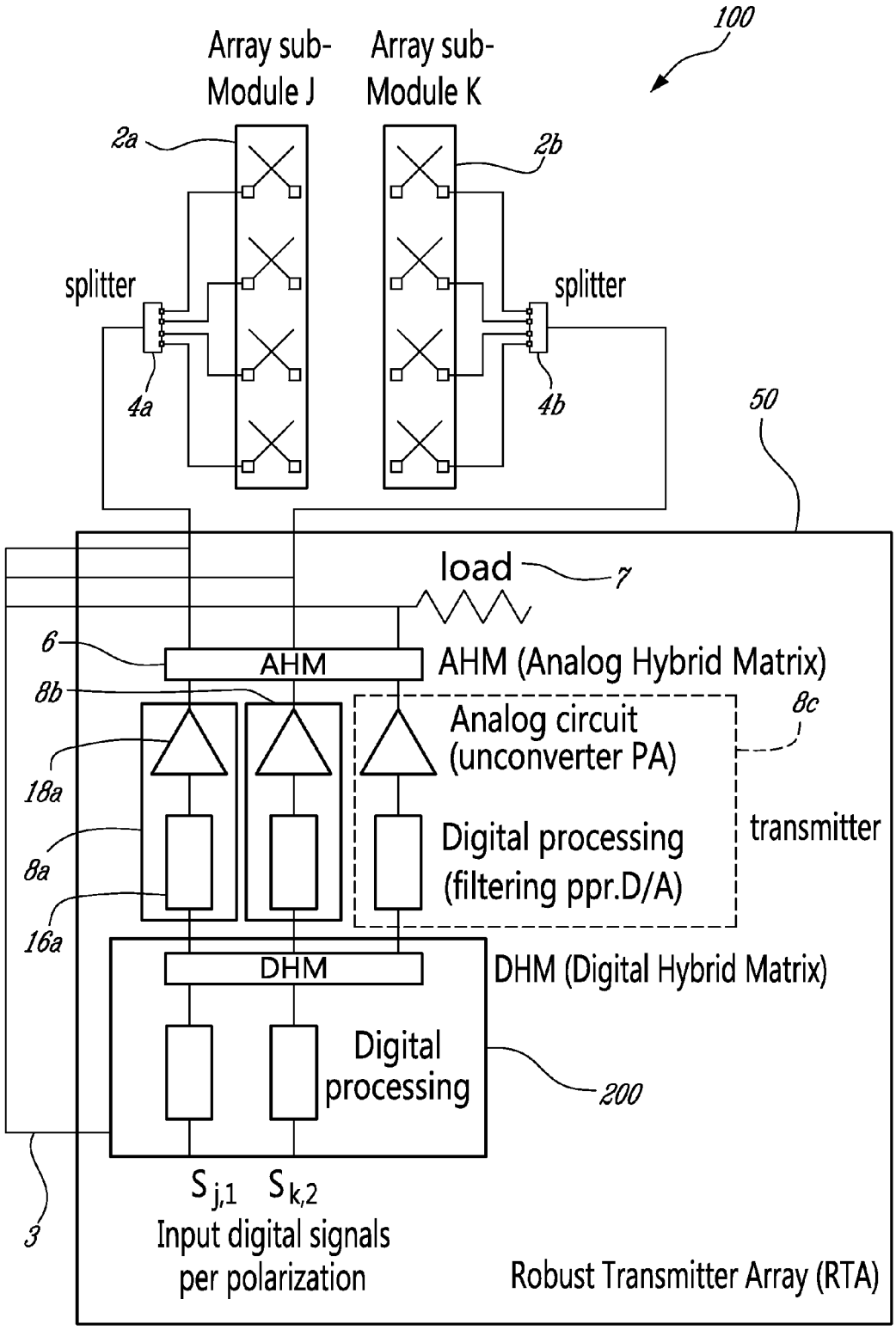
FIG. 2 is a functional block diagram of the robust transmitter array according to an embodiment.

FIG. 2 is a functional block diagram of a robust transmitter array 50 according to an embodiment. Shown in FIG. 2 is transmission subsystem 100 of a voice/data wireless communication system 300 as shown in FIG. 1. Transmission subsystem 100 includes antenna array modules 2*a,b*, and robust transmitter array system 50 according to an embodiment. The exemplary robust transmission array (RTA) 50 shown in FIG. 2 can be characterized as an N=3 (three transmitter sub-assemblies 8), M=2 (two active and one redundant transmitter sub-system) RTA 50. However according to other exemplary embodiments, N is 2 or more and M is 1 or more. RTA 50 includes, in this particular exemplary embodiment, two input signals $S_{J,1}$ and $S_{K,2}$ that are input to digital signal processor 200. Digital signal processor 200 includes, among other items (discussed in greater detail below), digital hybrid matrix 10.

The outputs of digital signal processor 200 (in this exemplary embodiment, there are three outputs, that correspond to the N−3 transmitters, though, as discussed below, one of the signals is eventually terminated in a load) are input to transmitter assemblies 8*a-c*. Each of transmitter assemblies 8*a-c* include, for example, digital-to-analog up-conversion assembly 16, and amplifier 18. Each digital-to-analog up-conversion assembly 16 includes a digital-to-analog converter, to convert the digitized voice and data signals into an analog signal, as well as the analog up-converter circuitry that up-converts the now-analog data and voice signals to an RF carrier frequency. The RF radio signals are then amplified by power amplifiers 18.

The outputs from each of the transmitter assemblies are input to an analog hybrid matrix (AHM) 6. Because some physical redundancy is designed into transmission sub-system 100, in this exemplary embodiment there is an extra (third) transmitter, e.g., transmitter assembly 8*c*, the output of which is fed into AHM 6. One of the outputs from AHM 6 is fed into dummy load 7. Dummy load 7 accepts the output of one of the ports of AHM 6, and essentially converts any signal energy which it receives from the one of the ports of AHM 6 to which it is connected to heat. As discussed in greater detail below, the signal energy of the third port of AHM 6 that is connected to dummy load 7 should be minimized in normal operation.

The other two outputs of AHM 6 feed splitters 4*a*, 4*b* which then each feed a different polarization of antenna array sub-module 2*a,b*. For example, antenna array sub-module 2*a* can be a vertically polarized antenna array, and antenna array sub-module 2*b* can be a horizontally polarized antenna array, or visa-versa, or the antenna arrays could be elliptical, circular (right hand, or left-hand circularization), among other configurations. According to a further embodiment, antenna array sub-module 2*a, b* could be part of the same column (where J and K are column numbers) of an antenna array, or could be part of different columns of an antenna array as illustrated in FIG. 2.

Figure 3:
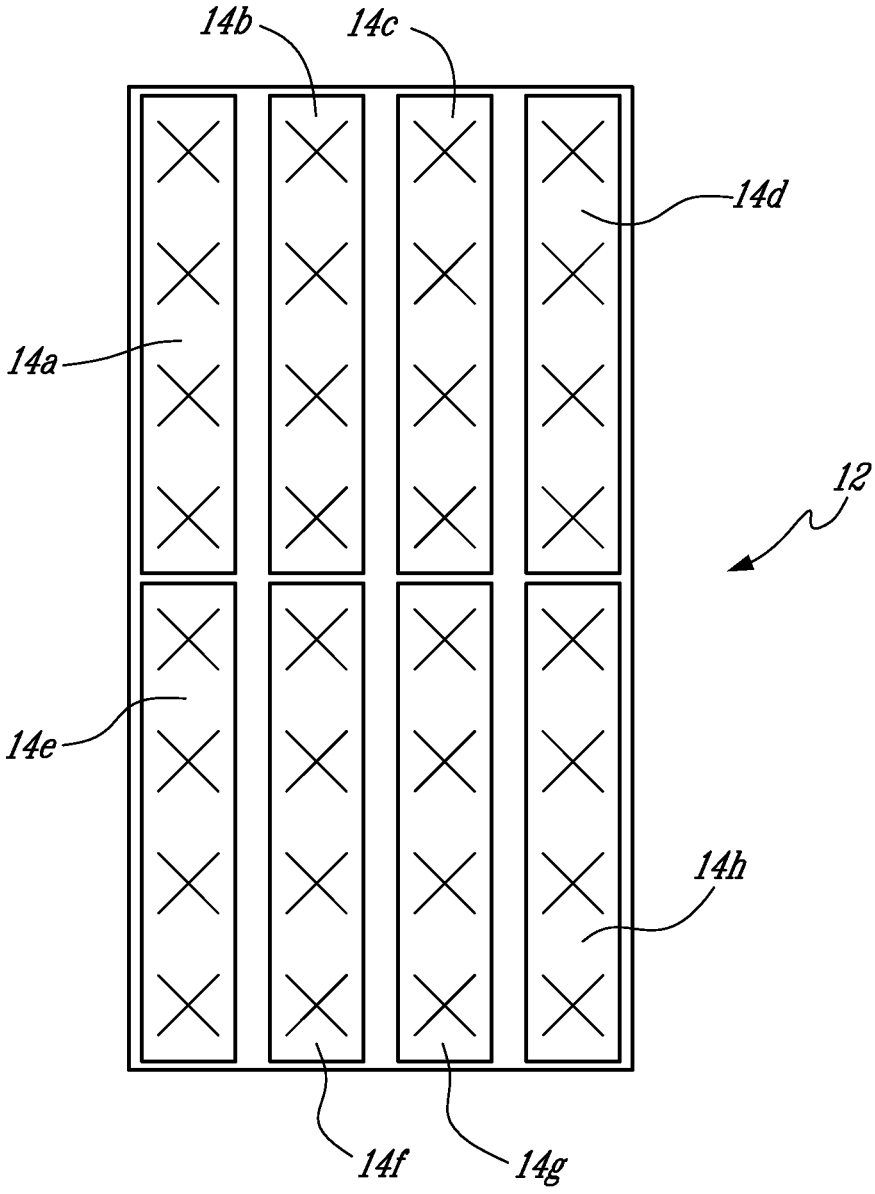
FIG. 3 is a functional block diagram of an antenna array example that can be used in the robust transmitter array shown in FIG. 2.

FIG. 3 is a functional block diagram of an alternative exemplary antenna array 12 that can be used in robust transmitter array 50 as shown in FIG. 2. Antenna array 12 shown in FIG. 3 includes 8 array sub-modules 14*a-h*, arranged in a 4×8 cross polarization antenna array using eight 4 element array sub-modules 14*a-h*. That is, in each of sub-module 14, there are 4 elements (denoted by the "X", having two polarizations). According to an embodiment, an antenna array will have at least one column, at least one polarization and at least one element in an array sub-module. For example, referring back to FIG. 2, if array sub-module 2*b* were removed, and there was only one "X" element in sub-module 2*a*, that would be an example of a single column, one element antenna array. It will be appreciated by those skilled in the art that other types of antenna arrays can be used in conjunction with robust transmitter arrays according to other embodiments.

Referring back to the exemplary embodiment of FIG. 2, the signals feeding each of the polarizations of antenna array sub-modules 2*a,b* are preferably statistically independent or uncorrelated so that power is always evenly spread across the three transmitter assemblies 8*a-c*. According to an embodiment, the two outputs from AHM 6 can be routed to different polarizations on different antenna array sub-modules 2 and/or in different columns (as shown in FIG. 3) so that power remains equally shared even in the case where there is amplitude taper across the columns (such as is used to reduce side lobes in a beam-forming application).

Figure 4:
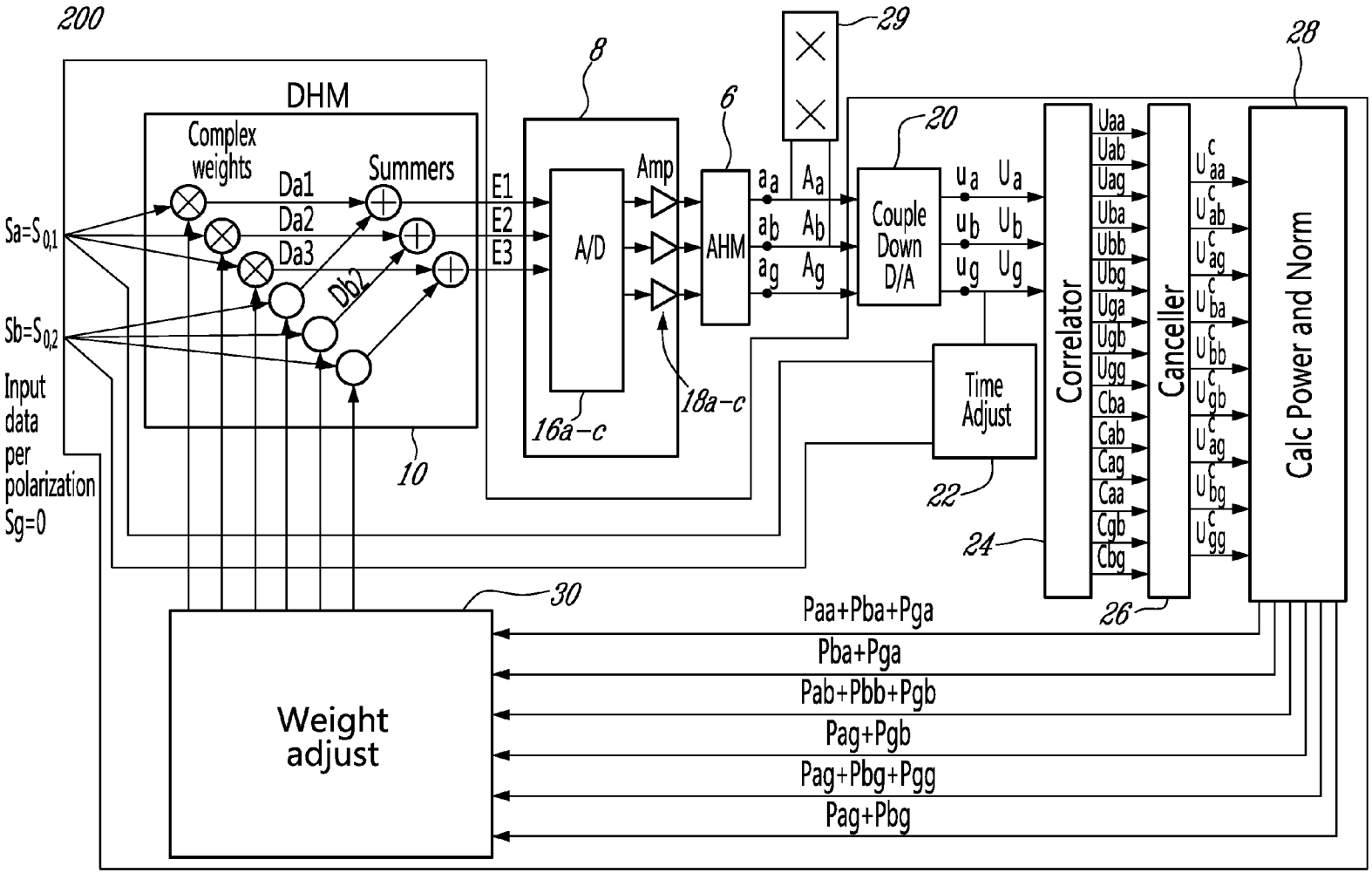
FIG. 4 is a functional block diagram of a digital signal processor for use in the robust transmitter array shown in FIG. 2.

FIG. 4 is a functional block diagram of an exemplary digital signal processor 200 which can be used in the RTA 50 shown in FIG. 2 according to an embodiment. Digital signal processor 200 includes digital hybrid matrix 10, analog-to-digital down conversion assembly 20, time adjust circuit 22, correlator 24, canceller 26, a cable power and normalization circuit 28, and weight adjustment unit 30. It will be appreciated by those skilled in the art that each of the functions represented by the different "circuits" or "assemblies" can be performed in one or more different devices, for example a single processor, or on a single or multiple processor assembly boards. Other devices that can be used include application specific integrated circuits, and/or special digital signal processing circuits or circuit assemblies, all of which are encompassed in various embodiments.

One purpose of digital signal processor 200 is to implement a signal-to-noise ratio (SNR) optimization algorithm that can be used to correct for non-ideal characteristics that exist in AHM 6, among other components in the transmit chain. As is well known to those of ordinary skill in the art, an analog hybrid matrix provides outputs that include sums and differences of the input signals. In this case, the first AHM output port which is fed to splitter 4*a* should contain only signal component $S_{J,1}$, and similarly for the second AHM output port should contain only signal components $S_{K,2}$. Because of temperature, humidity, age and other environmental conditions, as well as the fact that analog hybrid matrices are not perfect, phase, amplitude and delay differences will create outputs that introduce errors in the output signals. These "errors" include components of the other than intended signals for the particular output. Thus, one aspect of algorithms according to an embodiment is to adjust the complex weights generated by weight adjust unit 30 that are then multiplied in DHM 10 against each of the input signals (Sa which equals $S_{J,1}$, and Sb which equals $S_{K,2}$) to maximize signal Sa at output Aa and minimize Sa at Ab and Ag. Similarly, the output Sb at output Ab will be maximized by the complex weights generated by weight adjust unit 30 and Sb will be minimized at outputs Aa and Ag.

The goals or target values used by weight adjust function 30 are modified, however, according to an embodiment, when a failure occurs in order to automatically adjust the complex weights to minimize Sa at Ab, and modify Sa at AHM 6 outputs Aa and Ag, such that an equal amount of Sa goes to both AHM 6 outputs Aa and Ag. Similarly, for input signal Sb, when there is a transmitter failure, according to an embodiment, Sb is minimized at output Aa, and modified at AHM outputs Ab and Ag, such that an equal amount of Sb goes to both outputs Ab and Ag. In other words, when there is a transmitter failure, the algorithm used by digital signal processor 200 redistributes the power for each of the two input signals such that it is minimized for the non-used AHM output, and is ideally split evenly between the intended output of AHM 6 and the dummy load output of AHM 6. Details of the optimization algorithms can be found in U.S. Pat. No. 7,248,656, the entire contents of which are incorporated herein by reference.

Figure 5:
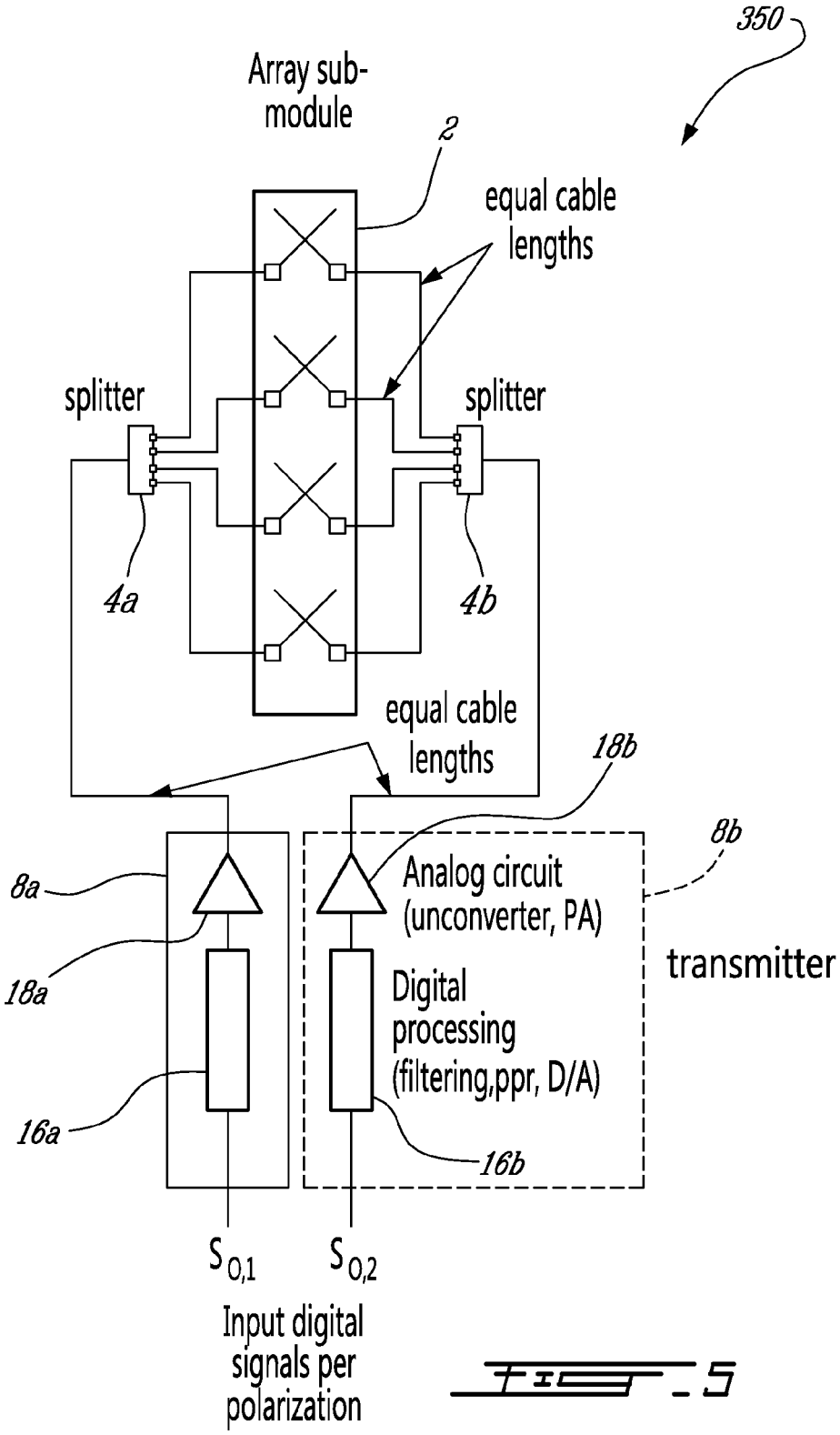
FIG. 5 is a functional block of a baseline transmitter array that utilizes only one transmitter per sub-array per polarization.

FIG. 5 is a functional block of baseline transmitter array 350 that utilizes only one transmitter per sub-array per polarization. As shown in FIG. 5, there is only one antenna array sub-module 2*a*, and no AHM 6. Two signals, $S_{0,1}$ and $S_{0,2}$ are input directly to a first transmitter 8*a*, and a second transmitter 8*b*, respectively, and the amplified signals are directly input through equal lengths of cable to splitters 4*a*, and 4*b*, again respectively. Compared to the signals generated by failure and non-failure of the baseline transmitter array 350 is the N=3, M=2 configuration of transmission sub-system 100 that includes robust transmitter array 50 according to an embodiment. The outputs of the transmission sub-system 100 correspond to the two polarizations of a cross-pole antenna array. N=3 was also chosen for simplicity and to avoid potential issues with correlated signals (e.g. in beam forming applications) based on the assumption that signals on the different polarizations will always be uncorrelated, however this value for N is not required for all embodiments.

In order to quantify the effects of RTA 50 according to an embodiment, an "Integrated Impairment Ratio" (IIR) is calculated by normalizing the normal and failed patterns, performing an integration of the linear power delta over the observation angle, dividing by the integrated power of the normal pattern and then converting to dB. In other words, the IIR provides a normalized, integrated value that represents, over the range of transmission angles, the difference in transmission power in a non-failure mode and a failure mode.

More specifically, an Integrated Impairment Ratio (IIR) can, for example, be calculated as follows:

$$IIR = 10\log\left[\frac{\sum_{\theta=-90}^{\theta=90} |P_{norm}(\theta) - P_{fail}(\theta)|}{\sum_{\theta=-90}^{\theta=90} P_{norm}(\theta)}\right]$$

and $P_{norm}$=linear power without failure; and $P_{fail}$=linear power with failure.

In the testing of baseline transmitter array 350, the patterns are evaluated using equal magnitude and zero phase excitation of all of the elements, except in the case of a failure, where the magnitude is modified according to what would happen to each of the system configurations if the contribution from one of the transmitters is zero. The leakage from one polarization to the other (X-pol_Fail) does not come into play for the analyzed configurations so it can be ignored in all of the simulation FIGS. 6-8 (which is why there are only two lines for each of the radiation pattern figures).

Figure 6:
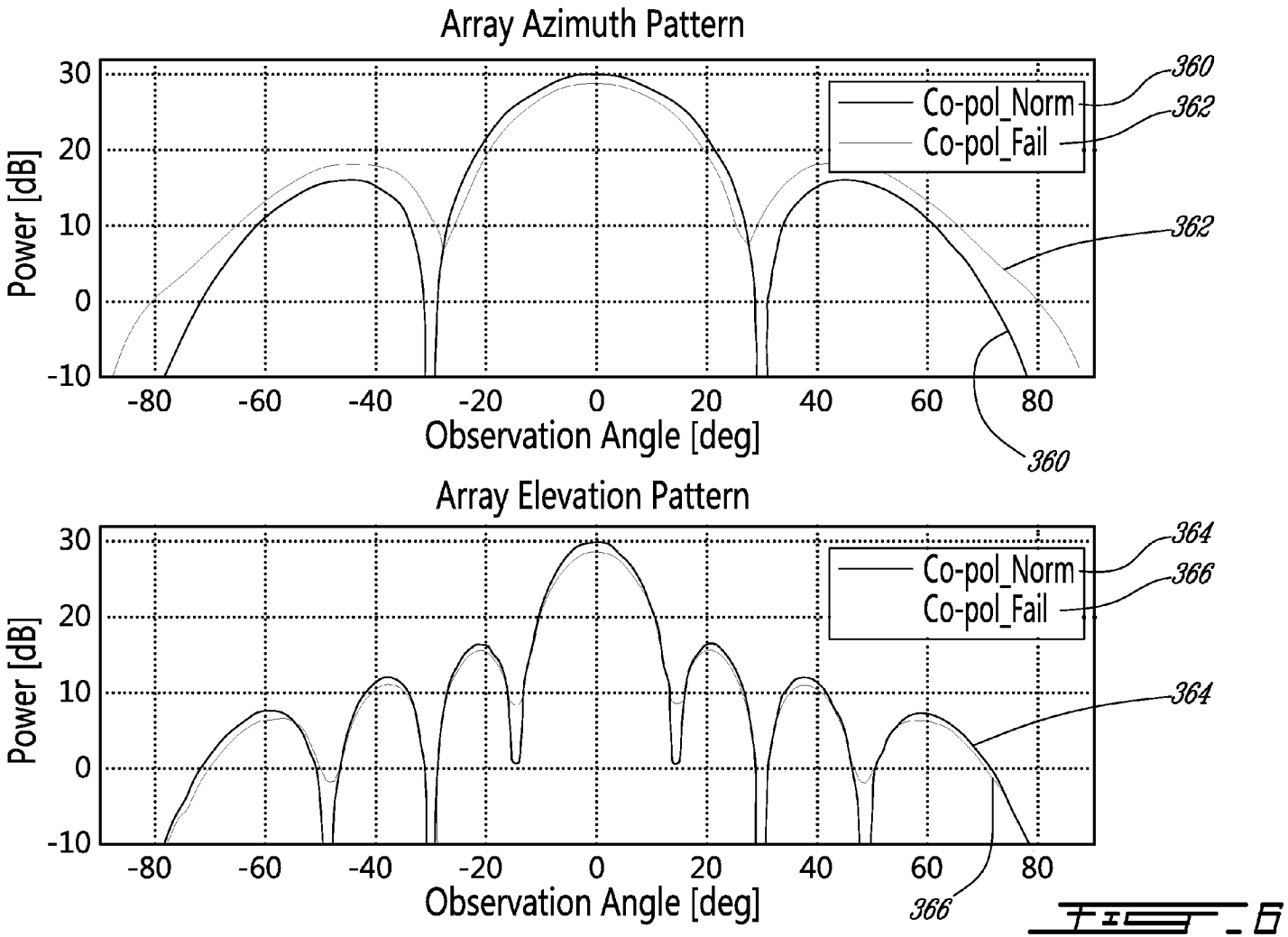
FIG. 6 illustrates the antenna radiation patterns with and without a transmitter failure for the baseline transmitter array shown in FIG. 5.

For example, FIG. 6 illustrates exemplary antenna radiation patterns with and without a transmitter failure for baseline transmitter array 350 shown in FIG. 5. In FIG. 6, line 360 represents the antenna array azimuth pattern for a transmitter non-failure mode in baseline transmitter array 350, and line 362 represents the antenna array azimuth pattern for a transmitter failure mode in baseline transmitter array 350. Also shown in FIG. 6, line 364 represents the antenna array elevation pattern for a transmitter non-failure mode in baseline transmitter array 350, and line 366 represents the antenna array elevation pattern for a transmitter failure mode in baseline transmitter array 350. A calculation of the IIR for each pattern shows that there is an IIR between the non-failure mode and failure mode of about −9 dB in azimuth, and an IIR between the non-failure mode and the failure mode of about −17 dB in elevation. The larger the negative value in dB, the less effect that is caused by the failure of the transmitter (i.e., the impact of the failure is much smaller).

Figure 7:
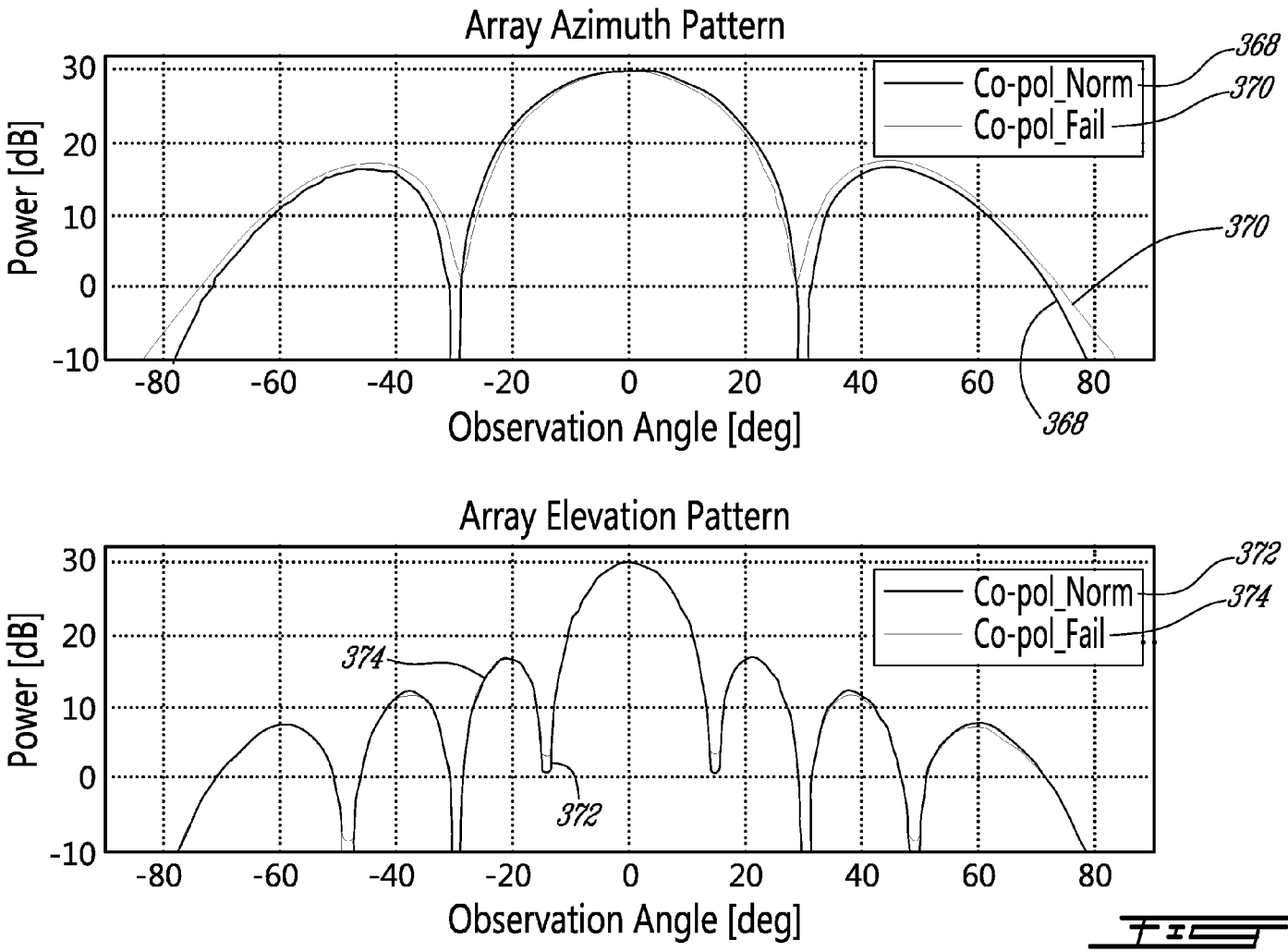
FIG. 7 illustrates the antenna radiation patterns with and without a transmitter failure for the robust transmitter array shown in FIG. 2.

FIG. 7 illustrates exemplary antenna radiation patterns with and without a transmitter failure for robust transmitter array 50 (without power boost) shown in FIG. 2 according to an embodiment. Therein, line 368 represents the antenna array azimuth pattern for a transmitter non-failure mode in robust transmitter array 50, and line 370 represents the antenna array azimuth pattern for a transmitter failure mode in robust transmitter array 50 without power boost. Also shown in FIG. 7, line 372 represents the antenna array elevation pattern for a transmitter non-failure mode in robust transmitter array 50, and line 374 represents the antenna array elevation pattern for a transmitter failure mode in robust transmitter array 350 without power boost. In the system configuration of FIG. 2, the robust transmitter array 50 without power boost, the goal of the optimization algorithm is modified to automatically adjust the complex weights to minimize Sa at Ab such that an equal amount of Sa goes to Aa and Ag, and that an equal amount of Sb goes to Ab and Ag, as discussed above. It can be seen in FIG. 7 that the impact of a transmitter failure on the antenna patterns is much smaller for robust transmitter array 50 (even without power boost) than for the baseline transmitter array 350. The IIR value in the azimuth for robust transmitter array is −13 dB, which is 4 dB better than the IIR value for the azimuth in baseline transmitter array 350 (−9 dB), and the IIR value in the elevation for robust transmitter array 50 is −25 dB which is 8 dB better than the IIR value in the elevation for baseline transmitter array 350 (−17 dB).

Figure 8:
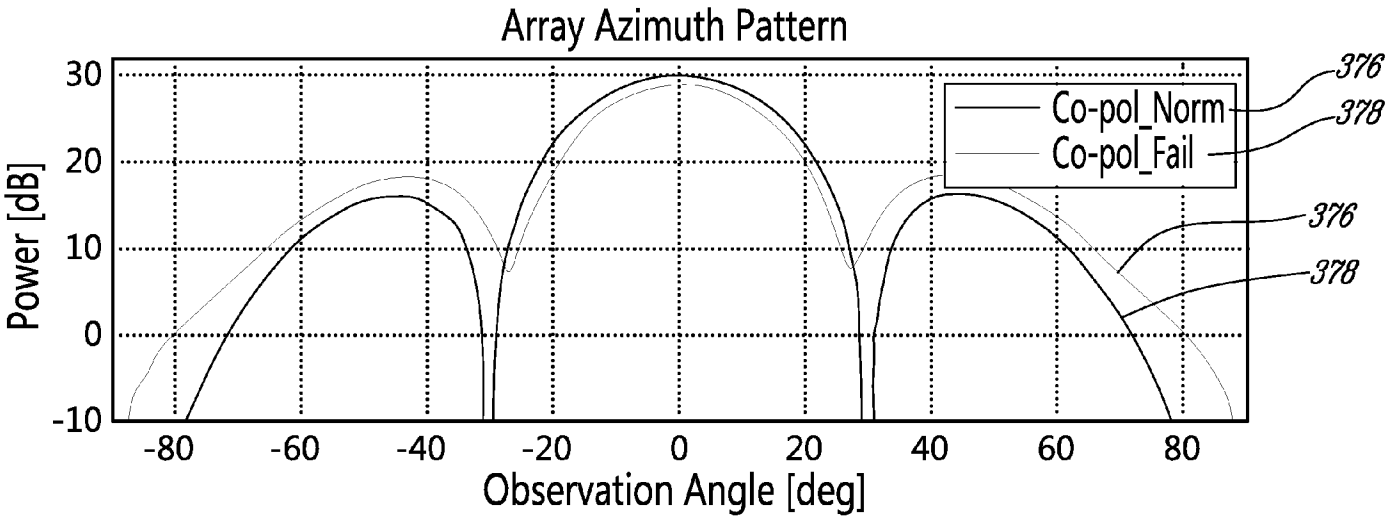
FIG. 8 illustrates the antenna radiation patterns with and without a transmitter failure for the robust transmitter array shown in FIG. 2 with power boosting according to a further embodiment.
Figure 8:
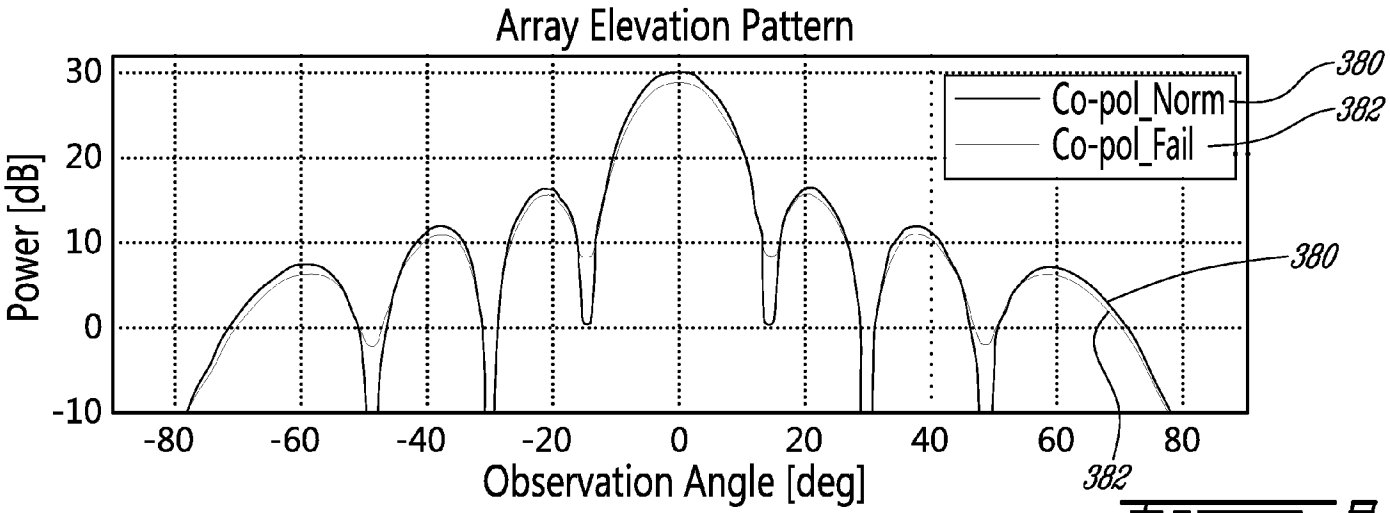

FIG. 8 illustrates exemplary antenna radiation patterns with and without a transmitter failure for the robust transmitter array shown in FIG. 2 with power boosting according to a further embodiment. Therein, line 376 represents the antenna array azimuth pattern for a transmitter non-failure mode in robust transmitter array 50, and line 378 represents the antenna array azimuth pattern for a transmitter failure mode in robust transmitter array 50 with power boost. Also shown in FIG. 8, line 380 represents the antenna array elevation pattern for a transmitter non-failure mode in robust transmitter array 50, and line 382 represents the antenna array elevation pattern for a transmitter failure mode in robust transmitter array 350 with power boost. It is thus apparent that the effect of the power boost is to make virtually indistinguishable the differences in transmission power between a failure mode and non-failure mode when using robust transmitter array 50. With gain/power boosting of the remaining transmitters, it is possible to maintain full performance under a transmitter failure condition. In this exemplary system configuration the power is boosted by 4.8 dB in the remaining two transmitters.

FIG. 9 is a table that summarizes the azimuth and elevation integrated impairment ratios for the baseline and robust transmitter array configurations with and without power boosting that were discussed above with respect to FIGS. 6-8. The amount of power boosting required to maintain full performance under a transmitter failure condition is a function of N and M. For example the power boosting for N=5, M=4 is 4.0 dB. For N=4, M=2 the power boosting is 3.0 dB. In general as N increases and/or as N-M increases, the amount of power boosting required is reduced. According to an embodiment, the gain/power boost of the transmitter can be accomplished using a combination of extra headroom in the power amplifier, reducing the peak-to-average transmission output, and/or leveraging the portion of the thermal budget that will no longer be used by the failed transmitter. The end result is that the antenna patterns are substantially unchanged from the normal case. Half of the RF power that is produced by the RTA 50 that has a transmitter failure is dissipated in the load for that RTA, but this has no impact on the antenna patterns. The IIR for both the azimuth and elevation patterns is calculated to be over −100 dB, indicating substantially little or no impact has been caused by the lost transmitter.

From the foregoing discussion of various exemplary embodiments, it will be appreciated that employing robust transmitter arrays in accordance with such embodiments provides for a number of benefits and advantages. For example, under a transmitter failure condition, RTA 50 improves the performance of an active antenna array system or a radio system with multiple transmitters coupled to a passive antenna array system. Moreover, use of RTA 50 improves the MTBF of an active antenna array system or of a radio system with multiple transmitters coupled to a passive antenna system. Further, according to an embodiment, when there are no failed transmitters the power is shared between all of the transmitters, unlike a system with switched standby transmitters which are of no use when in standby. In standby, the standby transmitters simply waste power, and thus cost more to include in tower designs, and reduce the overall reliability of the system. In the case where RF power required is not the same for each of the outputs of RTA 50 (such as a beamforming application with amplitude taper) this can be handled with all transmitters running at the same power level for maximum efficiency and minimum cost. This scenario was briefly described above, wherein the outputs of RTA 350 feed different columns of antenna array sub-modules 2*a, b*.

Figure 10:
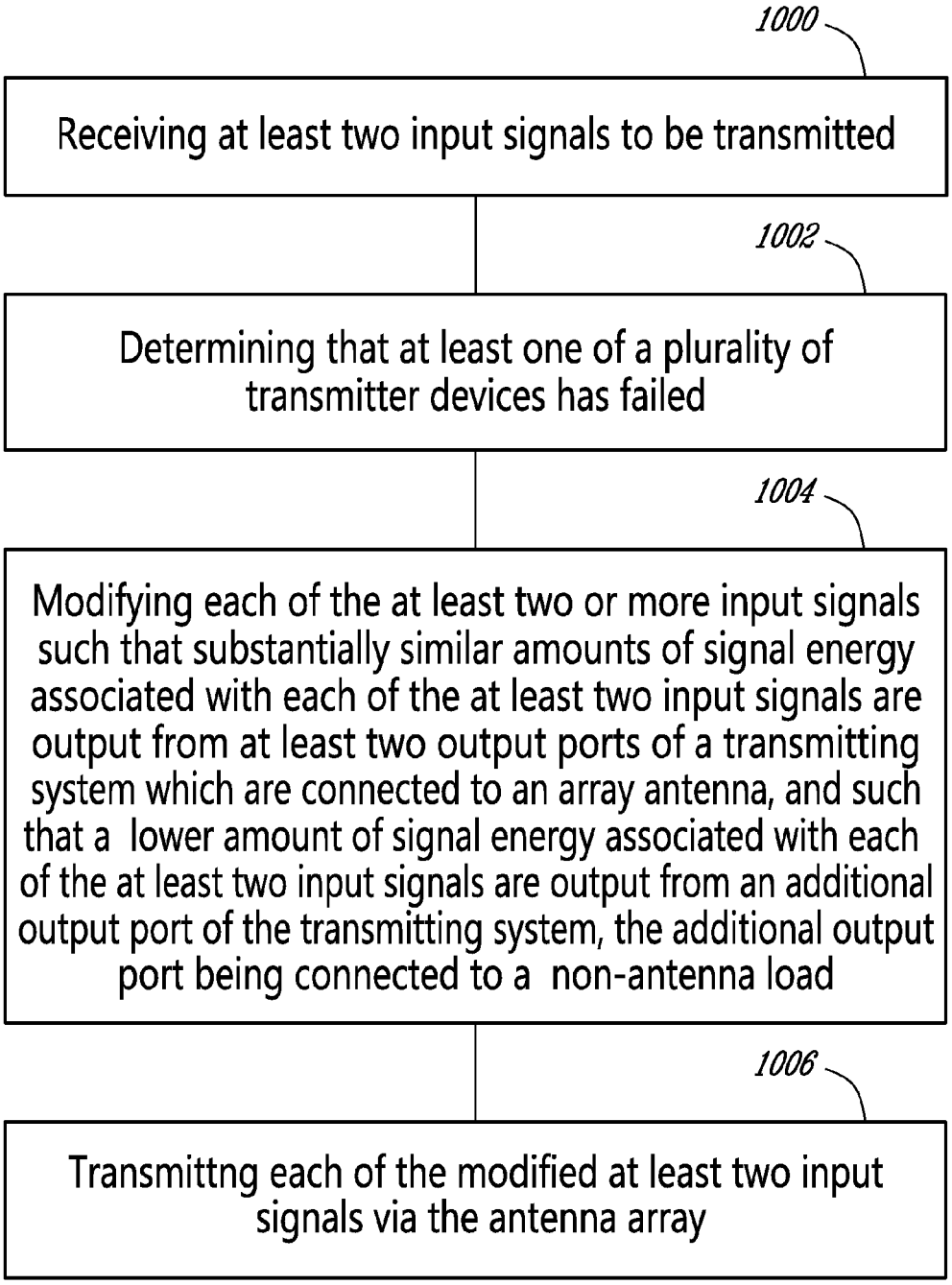
FIG. 10 is a flowchart illustrating a method according to an embodiment.

Thus according to an embodiment, a method of compensating for a failure in at least one of a plurality of transmitter devices in a wireless communication system can include the steps illustrated in the flowchart of FIG. 10. Therein, at step 1000, at least two input signals to be transmitted are received, e.g., by a robust transmitter array or system. A determination is made, at step 1002, that at least one of the plurality of transmitter devices has failed. Then, each of the at least two or more input signals are modified, at step 1004, such that substantially similar amounts of signal energy associated with each of the at least two input signals are output from at least two output ports of a transmitting system which are connected to an array antenna, and such that a lower amount of signal energy associated with each of the at least two input signals are output from an additional output port of the transmitting system, the additional output port being connected to a non-antenna load. The modified input signals are then transmitted via the antenna array at step 1006.

The foregoing description of exemplary embodiments provides illustration and description, but it is not intended to be exhaustive or to limit the invention to the precise form disclosed. Modifications and variations are possible in light of the above teachings or may be acquired from practice of the invention. The following claims and their equivalents define the scope of the invention.

The invention claimed is:

1. A wireless communication system comprising:

an antenna array system including at least one column with at least one antenna element, and at least one polarization; and a transmitter system, including a plurality of transmitter devices, configured to receive respective input signals, process said respective input signals to generate processed signals and transmit the processed signals through the antenna array system, wherein at least one output port of the transmitter system is connected to a non-antenna load;

in the event of a failure of any of the plurality of transmitter devices, the transmitter system including a signal processor configured to modify the respective input signals, and the remaining operational transmitter devices configured to increase their output power by an amount determined in accordance with a total number of transmitter devices in the plurality, such that substantially no transmitted signal power is lost relative to the case wherein there is no failure of any of the plurality of transmitter devices; and wherein substantially similar amounts of signal energy associated with each of the respective input signals are output from the transmitter system to the antenna array system after said failure relative to the case wherein there is no failure of any of the plurality of transmitter devices.

2. The wireless communication system according to claim 1, further comprising:

an analog hybrid matrix configured to provide transmission paths for each of the respective input signals from each of the plurality of transmitter devices to the antenna array system.

3. The wireless communication system according to claim 1, wherein the signal processor comprises:

a digital hybrid matrix configured to combine weight adjusted feedback signals corresponding to the respective input signals with the respective input signals such that when there is no failure of any of the plurality of transmitter devices, a maximum amount of signal energy associated with a first of the respective input signals is output from the transmitter system at a first output and a minimum amount of signal energy associated with the first of the respective input signals is output from the transmitter system at other outputs.

4. The wireless communication system according to claim 3, wherein the digital hybrid matrix combines weight adjusted feedback signals corresponding to the respective input signals with the respective input signals such that when there is no failure of any of the plurality of transmitter devices a maximum amount of signal energy associated with a second of the respective input signals is output from the transmitter system at a second output and a minimum amount of signal energy associated with the second of the respective input signals is output from the transmitter system at additional outputs.

5. The wireless communication system according to claim 3, wherein the digital hybrid matrix combines weight adjusted feedback signals corresponding to the respective input signals with the respective input signals such that when there is a failure of any of the plurality of transmitter devices, an equal amount of signal energy associated with the first of the respective input signals is output from the transmitter system to a first portion of the antenna array system and a non-transmitting portion, and further wherein a minimized portion of the first of the respective input signals is sent to a second portion of the antenna array system, and further wherein, an equal amount of signal energy associated with a second of the respective input signals is output from the transmitter system to a second portion of the antenna array system and a non-transmitting portion, and further wherein a minimized portion of the second of the respective input signals is sent to a first portion of the antenna array system.

6. The wireless communication system according to claim 1, wherein as the total number of transmitter devices increases, less output power increasing is required such that substantially no transmitted signal power is lost relative to the case wherein there is no failure of any of the plurality of transmitter devices.

7. The wireless communication system according to claim 1, wherein the amount that the remaining operational transmitter devices increase their output power by is further determined in accordance with a difference between the total number of transmitter devices in the plurality and a total number of remaining operational transmitter devices.

8. The wireless communication system according to claim 7, wherein as the difference between the total number of transmitter devices and the total number of remaining operational transmitter devices increases, less output power increasing is required such that substantially no transmitted signal power is lost relative to the case wherein there is no failure of any of the plurality of transmitter devices.

9. A method of compensating for a failure in at least one of a plurality of transmitter devices in a wireless communication system, comprising:

receiving at least two input signals to be transmitted;

determining that at least one of the plurality of transmitter devices has failed;

modifying each of the at least two input signals such that substantially similar amounts of signal energy associated with each of the at least two input signals are output from at least two output ports of a transmitting system which are connected to an array antenna, and such that a lower amount of signal energy associated with each of the at least two input signals are output from an additional output port of the transmitting system, the additional output port being connected to a non-antenna load;

increasing a power output from the remaining operational transmitter devices by an amount determined in accordance with a total number of transmitter devices in the plurality, such that substantially no transmitted signal power is lost relative to the case wherein there is no failure of any of the plurality of transmitter devices; and transmitting each of the modified at least two input signals via the antenna array.

10. The method according to claim 9, wherein the modifying of each of the at least two input signals comprises:

weighting each of the at least two or more input signals based on adjusted feedback signals corresponding to each of the transmitted signals such that when there is no failure of any of the transmitter devices, a maximum amount of signal energy associated with a first of the at least two input signals is output from a first output port of the transmitting system and a minimum amount of signal energy associated with the first of the at least two input signals is output from the additional output port of the transmitting system.

11. The method according to claim 10, wherein modifying of each of the at least two input signals further comprises:

weighting each of the at least two input signals based on adjusted feedback signals corresponding to each of the transmitted signals such that when there is no failure of any of the transmitter devices a maximum amount of signal energy associated with a second of the at least two input signals is output from a second output port of the transmitting system and a minimum amount of signal energy associated with the second of the at least two input signals is output from the additional output port of the transmitting system.

12. The method according to claim 9, wherein in the event of a failure of at least one of the plurality of transmitter devices, a redundant transmitter device transmits the signals with the remaining non-failed transmitting devices.

13. The method according to claim 9, further comprising:

combining weight adjusted feedback signals corresponding to the at least two input signals with the at least two input signals such that when there is a failure of any of the transmitter devices, an equal amount of signal energy associated with a first of the at least two input signals is output from the transmitting system to a first portion of the antenna array system and a non-transmitting portion, and further wherein a minimized portion of the first of the at least two input signals is sent to a second portion of the antenna array system, and further wherein, an equal amount of signal energy associated with a second of the at least two input signals is output from the remaining transmitter device to a second portion of the antenna array system and a non-transmitting portion, and further wherein a minimized portion of the second of the at least two input signals is sent to a first portion of the antenna array system.

14. The method according to claim 9, wherein the amount that the power output from the remaining operational transmitter devices is increased is further determined in accordance with a difference between the total number of transmitter devices in the plurality and a total number of remaining operational transmitter devices.

15. A transmitter array comprising:

an antenna array;

an analog hybrid matrix connected to the antenna array;

a plurality of transmitters connected to the analog hybrid matrix; and a digital hybrid matrix connected to the plurality of transmitters and configured to modify received input signals with weight adjustments, wherein the analog hybrid matrix is connected to the antenna array via at least two ports and is connected to a non-antenna load via at least one port; and wherein pre-failure and post-failure distortion characteristics of signals transmitted via the transmitter array are substantially similar.

16. The transmitter array of claim 15, wherein the digital hybrid matrix is configured such that upon failure of at least one of the plurality of transmitters, an equal amount of power of a first input signal is output from a first output of the analog hybrid matrix to the antenna array and a third output of the analog hybrid matrix to a non-transmitting device, and an equal amount of power of a second signal is output from a second output of the analog hybrid matrix to the antenna array and the third output of the analog hybrid matrix to the non-transmitting device.

17. The transmitter array of claim 15, wherein the digital hybrid matrix further modifies the received input signal such that a minimized amount of power of the first signal is output from the second output of the analog hybrid matrix and a minimized amount of power of the second signal is output from the first output of the analog hybrid matrix.

18. The transmitter array of claim 15, wherein the non-antenna load includes a resistor.

* * * * *